US011365470B2

(12) United States Patent
Hanson et al.

(10) Patent No.: US 11,365,470 B2
(45) Date of Patent: Jun. 21, 2022

(54) CERAMIC COATING FORMATION USING TEMPERATURE CONTROLLED GAS FLOW TO SMOOTH SURFACE

(71) Applicant: General Electric Company, Schenectady, NY (US)

(72) Inventors: Gerhart LaMoyne Hanson, Simpsonville, SC (US); Martin Lewis Smith, Easley, SC (US)

(73) Assignee: General Electric Company, Schenectady, NY (US)

( * ) Notice: Subject to any disclaimer, the term of this patent is extended or adjusted under 35 U.S.C. 154(b) by 14 days.

(21) Appl. No.: 16/737,295

(22) Filed: Jan. 8, 2020

(65) Prior Publication Data

US 2021/0207256 A1 Jul. 8, 2021

(51) Int. Cl.

| | |
|---|---|
| ***C23C 4/134*** | (2016.01) |
| ***B05B 7/20*** | (2006.01) |
| ***B05B 7/22*** | (2006.01) |
| ***C23C 4/11*** | (2016.01) |
| ***B05B 7/16*** | (2006.01) |
| ***B05B 12/10*** | (2006.01) |
| ***B05B 13/02*** | (2006.01) |
| ***B05B 13/04*** | (2006.01) |
| ***C23C 4/18*** | (2006.01) |
| ***H05H 1/26*** | (2006.01) |
| *C23C 4/123* | (2016.01) |

(Continued)

(52) U.S. Cl.

CPC ..... *C23C 4/11* (2016.01); *B05B 7/16* (2013.01); *B05B 7/20* (2013.01); *B05B 7/222* (2013.01); *B05B 12/10* (2013.01); *B05B 13/0278* (2013.01); *B05B 13/04* (2013.01); *C23C 4/134* (2016.01); *C23C 4/18* (2013.01); *H05H 1/26* (2013.01); *B05B 13/0431* (2013.01); *C23C 4/123* (2016.01); *C23C 4/129* (2016.01); *C23C 4/131* (2016.01)

(58) Field of Classification Search

None

See application file for complete search history.

(56) References Cited

U.S. PATENT DOCUMENTS

| | | | |
|---|---|---|---|
| 4,887,545 | A | 12/1989 | Soininen |
| 6,103,315 | A | 8/2000 | Gray et al. |
| 7,064,927 | B2 | 6/2006 | Erickson et al. |

(Continued)

OTHER PUBLICATIONS

European Search Report for corresponding EP Application No. EP20216760 dated Feb. 9, 2021, 7 pages.

*Primary Examiner* — Binu Thomas

(74) *Attorney, Agent, or Firm* — James Pemrick; Hoffman Warnick LLC

(57) ABSTRACT

A method and coating system are provided that use a temperature controlled gas flow to smooth a surface of a ceramic, like a thermal barrier coating (TBC). Thermal spray coating unit coats a ceramic on a surface. The thermal spray coating unit creates a flow of ceramic material towards the surface. A layer of at least partially molten ceramic material on the surface is smoothed by transmitting a flow of temperature controlled gas across the at least partially molten ceramic material on the surface after the thermal spray coating of the ceramic on the surface. The solidified ceramic has a smoother surface that requires much less polishing to attain a desired surface roughness.

11 Claims, 2 Drawing Sheets

(51) Int. Cl.
*C23C 4/129* (2016.01)
*C23C 4/131* (2016.01)

(56) References Cited

U.S. PATENT DOCUMENTS

| | | | | |
|---|---|---|---|---|
| 9,574,261 | B1 * | 2/2017 | Rogers | B05B 13/0421 |
| 2008/0193674 | A1 | 8/2008 | Siegert et al. | |
| 2008/0268164 | A1 * | 10/2008 | Thayer | C23C 16/042 118/715 |
| 2009/0162670 | A1 | 6/2009 | Lau et al. | |
| 2010/0221449 | A1 * | 9/2010 | Schlatterbeck | B05C 11/06 118/63 |
| 2012/0301624 | A1 | 11/2012 | Borchardt et al. | |
| 2015/0075714 | A1 | 3/2015 | Sun et al. | |
| 2019/0076975 | A1 * | 3/2019 | Komazawa | B23Q 11/1076 |

* cited by examiner

CERAMIC COATING FORMATION USING TEMPERATURE CONTROLLED GAS FLOW TO SMOOTH SURFACE

BACKGROUND

The disclosure relates generally to coating processes, and more particularly, to a method of thermal spraying a metal component with a ceramic, such as a thermal barrier coating (TBC), while transmitting a temperature controlled gas flow across the surface to smooth the ceramic.

Ceramics are used widely to coat surfaces. For example, ceramics can be used as thermal barrier coatings (TBC) that may be applied to a variety of metal components, for example, in a turbomachine, to protect the underlying metal from high operating temperatures. TBCs may be applied to, for example, turbine blades, nozzles, and shrouds in gas turbines to protect them from the heat of combustion gases in the gas turbine. As the geometries of the metal components in turbomachines have become more complex and turbine operation temperatures have increased, thicker TBCs are being employed. Thicker TBCs present a challenge in maintaining a smooth TBC surface that does not impact performance. Typically, TBC surface roughness is the result of a combination of spray angle relative to the surface being coated, and surface contaminants by way of un-melted or partially melted powder particles residing on the surfaces, which are then coated over. The surface roughness worsens with thicker TBC coatings. Currently, the surface roughness issue is addressed by expensive surface polishing, e.g., with diamond coated disks, to remove the surface roughness and attain the desired surface finish.

BRIEF DESCRIPTION

A first aspect of the disclosure provides a method, comprising: thermal spray coating a ceramic on a surface, the thermal spray coating creating a flow of ceramic material towards the surface; smoothing a layer of at least partially molten ceramic material on the surface by transmitting a flow of temperature controlled gas across the at least partially molten ceramic material on the surface during the thermal spray coating of the ceramic on the surface; and solidifying the ceramic.

A second aspect of the disclosure provides a coating system, comprising: a thermal spray coating unit to apply a thermal barrier coating (TBC) across a surface, the thermal spray coating unit creating a flow of TBC material; an actuator operatively coupled to the thermal spray coating unit to move the thermal spray coating unit across the surface; and a gas nozzle configured to transmit a temperature controlled gas flow across at least partially molten TBC material on the surface as the thermal spray coating unit applies the TBC material on the surface, the gas nozzle capable of moving with the thermal spray coating unit.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
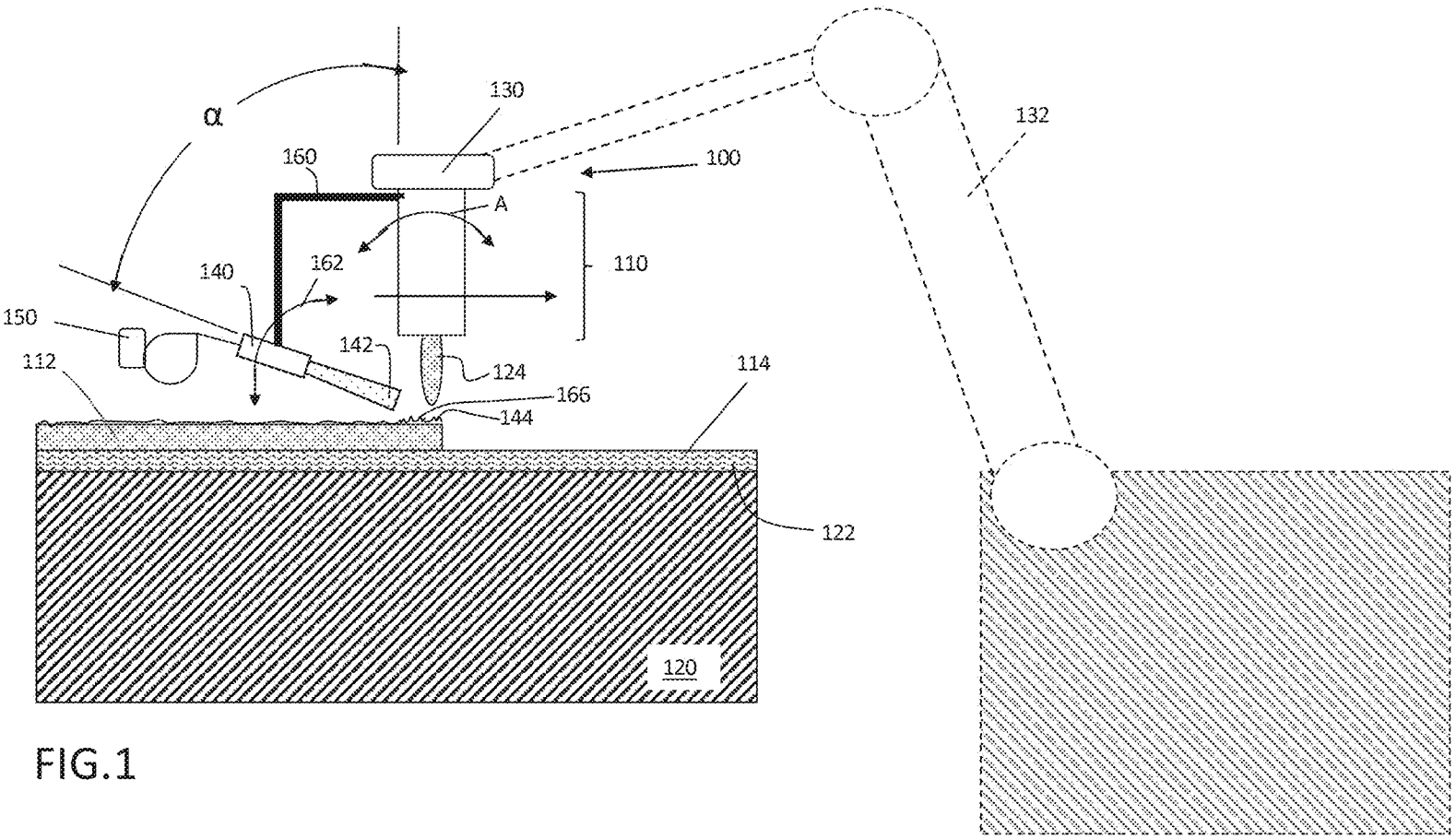
FIG. 1 is a schematic side view of a coating system according to embodiments of the disclosure.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Where an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Embodiments of the disclosure provide a method and coating system that use a temperature controlled gas flow to smooth a layer of ceramic, such as a thermal barrier coating (TBC), being applied. A thermal spray coating unit coats a ceramic on a surface. The thermal spray coating unit creates a flow of ceramic material towards the surface. A layer of at least partially molten ceramic material on the surface is smoothed by transmitting a flow of temperature controlled gas across the at least partially molten ceramic material on the surface after the thermal spray coating of the ceramic on the surface. The solidified ceramic can be thicker, and still have a smoother surface than if the flow of gas was not used. In one non-limiting example, the smoother surface may be approximately 200 rA compared to the conventional 400 rA. Hence, the ceramic can be thicker and requires much less polishing to attain a desired surface roughness.

Referring to the drawings, FIG. 1 shows a schematic side view of a coating system 100 according to embodiments of the disclosure. As illustrated, coating system 100 includes a thermal spray coating unit 110 to apply ceramic, such as a thermal barrier coating (TBC) 112, across a surface 114. While the teachings of the disclosure can be applied to any ceramic material, the disclosure will refer to TBC 112 for purposes of description. As used herein, "surface" may be that of a base material or substrate of a component, of an intermediate coating on the base material or substrate, or of a preceding layer of TBC. That is, surface 114 may be that of a component 120 (e.g., metal, ceramic layer(s), multi-material ceramic layer(s), etc.), or a layer on component 120, e.g., a bond coat 122 on metal component 120, or a preceding layer of TBC. Metal component 120 may include any now known or later developed metal, e.g., a superalloy or ceramic for use in a turbomachine. As used herein, "superalloy" refers to an alloy having numerous excellent physical characteristics compared to conventional alloys, such as but not limited to: high mechanical strength, high thermal creep deformation resistance, like Rene 108, CM247, Haynes alloys, Incalloy, MP98T, TMS alloys, CMSX single crystal alloys. In one embodiment, superalloys for which teachings of the disclosure may be especially advantageous are those superalloys having a high gamma prime (γ') value. "Gamma prime" (γ') is the primary strengthening phase in nickel-based alloys. Example high gamma prime superalloys include but are not limited to: Rene 108, N5, GTD 444, MarM 247 and IN 738.

Thermal spray coating unit 110 creates a flow of TBC material 124, e.g., a jet plume of ceramic material. Thermal spray coating unit 110 may employ any now known or later developed thermal process to project TBC material 124, or any other ceramic desired, onto surface 114. In one embodiment, thermal spray coating unit 110 may include a plasma spray unit. In other embodiments, thermal spray coating unit 110 may include an arc spray unit, a combustion spray unit, or a high velocity oxygen fuel (HVOF) coating unit. Thermal spray coating unit 110 may also include any of a variety of low pressure coating systems.

Bond coating 122, where used, may include any now known or later developed bond coat material such as but not limited to: nickel or platinum aluminides, nickel chromium aluminum yttrium (NiCrAlY) or nickel cobalt chromium aluminum yttrium (NiCoCrAlY). Bond coating 122 may have a thickness, for example, <500 microns. Where necessary, bond coating 122 and TBC 112 may be used together. TBC 112 may include any now known or later developed ceramic TBC material such as but not limited to: yttria-stabilized zirconia (YSZ), mullite, and alumina. TBC 112 may also include additional layers (not shown) such as a thermally grown oxide. TBC 112 may have a variety of porosities and/or densities. TBC 112 may be dense vertically cracked. As noted, complex metal component 120 geometries may require thicker TBC 112. To this end, TBC 112 may have a thickness ranging from, for example, approximately 0.127 millimeters (mm)(0.005 inches) to approximately 2.54 mm (0.1 inches), depending on the type of material being applied. TBC 112 and bond coating 122 may be over an entirety of surface 114 of metal component 120 or over just a portion of surface 114.

Coating system 100 may also include an actuator 130 operatively coupled to thermal spray coating unit 110 to move thermal spray coating unit 110 across surface 114, i.e., as it coats surface 114. Actuator 130 may include any now known or later developed actuator system, e.g., a linear actuator, motor, robotic system 132 (shown in phantom), etc., capable of controlled movement of thermal spray coating unit 110. Although shown at a generally perpendicular angle to surface 114, actuator 130 may also include an angle adjustment actuator (see arrow A) configured to control an attack angle of thermal spray coating unit 110 relative to surface, i.e., an angle of flow of TBC material 124 relative to surface 114. The angle of attack may allow for creating of different TBC attributes, e.g., density, porosity, thickness, etc.

Coating system 100 may also include a gas nozzle 140 configured to transmit a temperature controlled gas flow 142 across at least partially molten TBC material 144 (or other ceramic) on surface 114, i.e., as or after thermal spray coating unit 110 applies TBC material 124 on the surface 114. "At least partially molten" indicates that at least some of TBC material 144 is not solidified, e.g., it is semi-molten. As temperature controlled gas flow 142 impacts at least partially molten TBC material 144 it smooths a surface of the material. More particularly, gas flow 142 smooths portions of the peaks of at least partially molten TBC material 144, leaving smaller peaks. It may also remove un-melted or partially melted powder particles residing on surface 114. Temperature controlled gas flow 142 may be provided from any now known or later developed source, e.g., a pump (shown), pressurized supply, etc. Temperature controlled gas flow 142 may include air, or an inert gas such as argon or nitrogen. A thermal controller 150 may be provided to control a temperature of the temperature controlled gas. Thermal controller 150 may include any form of heat exchanger appropriate for the gas being used, e.g., an air conditioner, heater, etc. The temperature may be in a range of, for example, approximately 204.4° Celsius (° C.)(400° F.) to approximately 1093.3° C. (2000° F.). The temperature can be selected based on a number of factors such as but not limited to: ability to create the desired smoothing without otherwise impacting the solidifying of TBC material, ability to reduce surface roughness, type of gas, type of TBC material, room environment where applied, etc. As indicated schematically by, for example, coupling element 160, gas nozzle 140 may be directly coupled to move with thermal spray coating unit 110, or otherwise configured to move with thermal spray coating unit 110. In this fashion, as thermal spray coating unit 110 advances, gas nozzle 140 also advances. A distance between gas nozzle 140 and thermal spray coating unit 110 may be predefined, or may change during use depending on, for example, metal component 120 geometry.

Coating system 100 may also include an angle adjustment actuator 160 (shown schematically by arrows 162) operatively coupled to gas nozzle 140 to control an angle of attack of temperature controlled gas flow 142 relative to flow of TBC material 124. In one embodiment, angle adjustment actuator 160 controls angle of attack a of the temperature controlled gas flow 142 to be at between 5° to 85° relative to flow of TBC material 124. Angle of attack a may be predefined, or may change during use depending on, for example, TBC 112 thickness and/or metal component 120 geometry.

Figure 3:
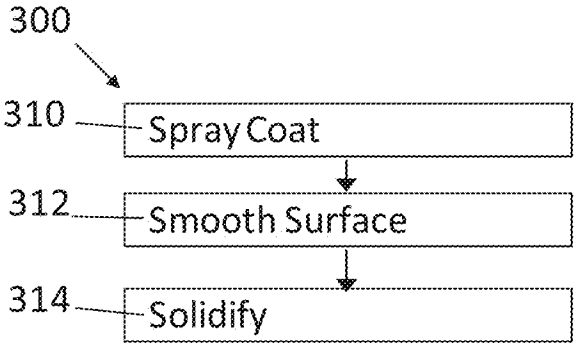
FIG. 3 is a block diagram of a method according to embodiments of the disclosure.

FIG. 3 shows a block diagram of a method 300 according to embodiments of the disclosure. In operation, as shown in FIG. 3 at process 310, coating system 100 thermal spray coats TBC 112 (or other ceramic) on surface 114, e.g., yttria-stabilized zirconia (YSZ), mullite, and alumina. That is, thermal spray coating unit 110 creates a flow of TBC material 124 towards surface 114, e.g., using plasma spraying of TBC material 124. TBC material 124 on surface 114 may have a thickness between, for example, approximately 0.127 millimeters (mm)(0.005 inches) to 2.54 mm (0.1 inches), depending on the material. As this occurs, in process 312 in FIG. 3, the layer of at least partially molten TBC material 144 on surface 114 is smoothed by transmitting a flow of temperature controlled gas flow 142 across at least partially molten TBC material 144 on surface 114 after the thermal spray coating of the TBC on the surface. Process P10 and P12 may occur simultaneously. Gas nozzle 140 for transmitting the flow of temperature controlled gas across surface 114 may move with thermal spray coating unit 110 for plasma spray coating the TBC 112 as thermal spray coating unit 110 moves over surface 114, i.e., because gas nozzle 140 is coupled to thermal spray coating unit 110 or otherwise configured to move with it. As noted, temperature controlled gas flow 142 may include air or an inert gas like argon or nitrogen, and may have a temperature in a range of, for example, approximately 204.4° Celsius (° C.)(400° F.) to approximately 1093.3° C. (2000° F.). The transmitting of the flow of temperature controlled gas flow 142 may include controlling an angle of attack of the flow relative to flow of TBC material 124 to optimize the smoothing. The angle of attack a of the flow of temperature controlled gas flow 142 is at between 5° to 85° relative to flow of TBC material 124. A pressure of temperature controlled gas flow 142 may also be controlled, e.g., between approximately 0.034 MegaPascal (MPa) (5 pounds per square inch (psi)) and approximately 0.82 MPa (120 psi). Other parameters of temperature controlled gas flow 142 may also be controlled, e.g., flow rate.

Figure 2:
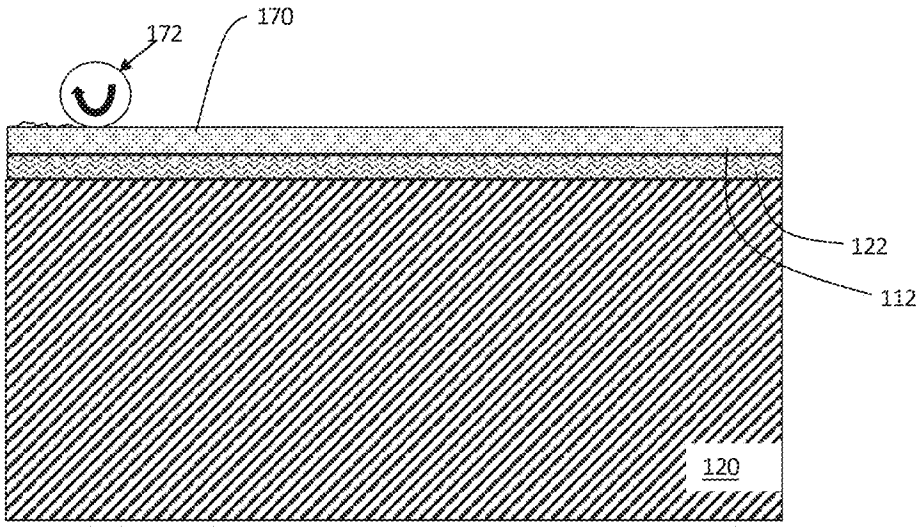
FIG. 2 is a schematic side view of polishing a TBC according to embodiments of the disclosure.

Once complete, in process 314 in FIG. 3, TBC 112 (or other ceramic) may be solidified. The solidification may include any now known or later developed solidifying treatment, e.g., doing nothing (atmospheric progression), cooling, heating, drying, exposure to certain types of light, etc. Any necessary curing process can follow the solidifying. Conventionally, TBC 112 would have a surface roughness of approximately 400 Ra after the solidifying. Roughness may be quantified by the variations in the direction of a surface from its ideal level. If variations are large, the surface is rough, and if they are small, the surface is smooth. As described in American Society of Mechanical Engineering (ASME) B46.1, Ra is the arithmetic average of the absolute values of the profile height deviations from the mean line, recorded within the evaluation length. That is, Ra is the average of a set of individual measurements of a surfaces minimums and maximum heights. Forming of TBC 112 according to embodiments of the disclosure may result in a roughness of approximately 200 Ra, which requires significantly less polishing to attain a desired surface roughness, e.g., of 40 Ra. FIG. 2 shows polishing surface 170 of TBC 112 to further smooth the surface of the TBC. Polishing may be performed using any now known or later developed polishing system 172, e.g., with diamond coated disks.

Embodiments of a method according to the disclosure clean the surface of metal component 120 but also smooths out the peaks of the layer of at least partially molten TBC material 144 by creating a cross plume jet of temperature controlled gas flow 142 to smooth out the peaks. The result is a much smoother final TBC surface.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately" as applied to a particular value of a range applies to both end values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A coating system, comprising:

a thermal spray coating unit to apply a ceramic thermal barrier coating (TBC) across a surface, the thermal spray coating unit creating a flow of ceramic TBC material;

an actuator operatively coupled to the thermal spray coating unit to move the thermal spray coating unit across the surface;

a gas nozzle configured to transmit a temperature controlled gas flow across at least partially molten ceramic TBC material on the surface as the thermal spray coating unit applies the ceramic TBC material on the surface to smooth the at least partially molten ceramic TBC material, the gas nozzle capable of moving with the thermal spray coating unit;

a thermal controller to control a temperature of the temperature controlled gas, wherein the temperature is in a range of approximately 204.4° Celsius (° C.) to approximately 1093.3° C.; and a coupling element that couples the gas nozzle with the thermal spray coating unit so that the gas nozzle moves with the thermal spray coating unit, wherein the coupling element further controls an angle of attack of the temperature controlled gas flow relative to the flow of ceramic TBC material.

2. The coating system of claim 1, wherein the temperature controlled gas is selected from the group comprising: air, argon, and nitrogen.

3. The coating system of claim 1, wherein the coupling element controls the angle of attack of the temperature controlled gas flow to be at between 5° to 85° relative to the flow of ceramic TBC material.

4. The coating system of claim 1, wherein the thermal spray coating unit includes plasma spray unit.

5. The coating system of claim 1, wherein the thermal spray coating unit includes an arc spray unit, a combustion spray unit, and a high velocity oxygen fuel (HVOF) coating unit.

6. The coating system of claim 1, wherein the ceramic TBC material includes yttria-stabilized zirconia (YSZ), mullite, and alumina.

7. The coating system of claim 1, wherein the ceramic TBC material on the surface has a thickness of 0.127 millimeters (mm) to 2.54 mm.

8. The coating system of claim 1, wherein the coupling element directly couples the gas nozzle with the thermal spray coating unit.

9. The coating system of claim 1, wherein the coupling element is positioned between the gas nozzle and the thermal spray coating unit and directly couples the gas nozzle with the thermal spray coating unit.

10. The coating system of claim 1, wherein a distance between the gas nozzle and the thermal spray coating unit is predefined.

11. The coating system of claim 1, wherein a distance between the gas nozzle and the thermal spray coating unit is adjustable.

* * * * *